United States Patent [19]

Webster, Jr.

[11] 4,412,651

[45] Nov. 1, 1983

[54] HEATING UNIT

[76] Inventor: John E. Webster, Jr., 180 High Range Rd., Londonderry, N.H. 03053

[21] Appl. No.: 371,824

[22] Filed: Apr. 26, 1982

[51] Int. Cl.[3] ..... F24C 9/00

[52] U.S. Cl. ..... 237/1 R; 126/247; 122/26

[58] Field of Search ..... 237/1 R, 50; 126/247, 126/400; 122/26

[56] References Cited

U.S. PATENT DOCUMENTS 2,683,448 7/1954 Smith ..... 126/247

4,250,866 2/1981 Telkes ..... 126/400

*Primary Examiner*—Daniel J. O'Connor

*Attorney, Agent, or Firm*—Hayes, Davis & Soloway

[57] ABSTRACT

A space heating unit comprises a pump forcing a working fluid such as a heavy synthetic oil through a shearing means to effect working and consequent heating thereof. The thus heated working fluid is passed through a heat exchanger to warm air circulating therethrough. The space heater is designed to operate cyclically with the heat exchanger and thus the working fluid being maintained at a minimum operating temperature by means of a heat store in heat exchange contract with at least a portion of the heat exchanger. The heat store contains for example a eutectic mixture of salts which undergo a phase change at about the minimum operating temperature desired for the working fluid. The heat store removes and stores heat energy from the unit when it is operating and returns its heat energy to the unit when the unit is in its at-rest mode, thereby maintaining the temperature of the unit and of the working fluid for the next cycle.

3 Claims, 3 Drawing Figures

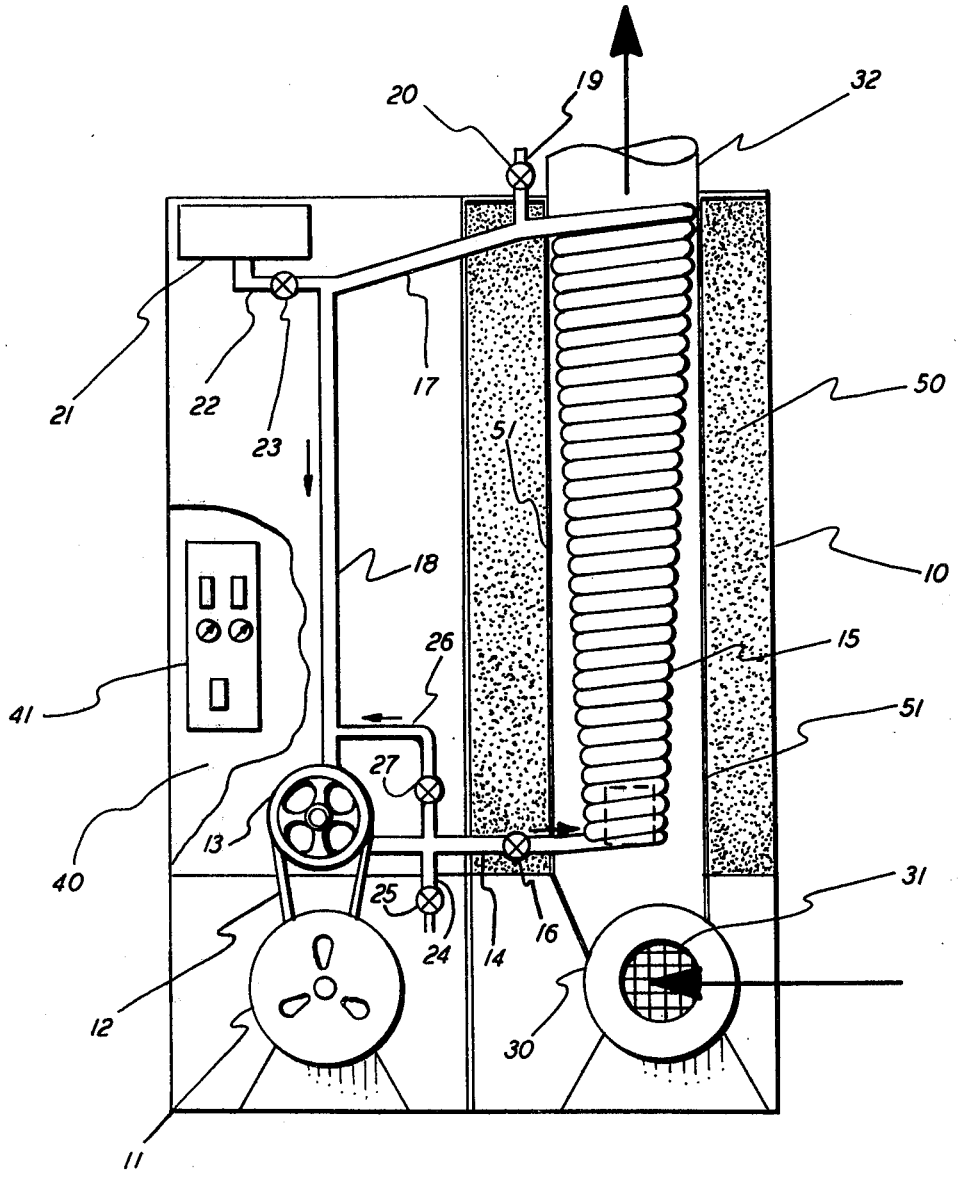
20
19
32
21
22
23
17
50
51
18
10
26
15
41
51
27
13
40
25
31
24
14
16
12
30
11

HEATING UNIT

This invention relates to a heating unit utilizing friction as a source of heat output.

Various mechanical devices have been proposed for converting mechanical energy to heat in a form useful for space heating. In particular it has been proposed to mechanically agitate or shear a gas such as air or a liquid such as water or oil to effect frictional heating of the fluid. The fluid thus heated can be used in a radiator or heat exchange for space heating.

For example, in U.S. Pat. No. 1,366,455 to G. S. Henson compressed air is agitated in an enclosed chamber by impeller blades and the air thus heated is used to heat water in a surrounding water bath which water is then passed to a radiator. The equipment is necessarily large relative to its specific heat output and the temperature level at which the radiator can operate is limited.

In U.S. Pat. No. 2,683,448 to J. P. Smith, a fluid is heated by being sheared between rotary and stationary blades and the heated fluid is then passed through a heat exchanger for heating air circulated to the heat exchanger by means of a blower.

In U.S. Pat. No. 3,813,036 to George H. Lutz oil under pressure is circulated through a woven metal wire mesh to agitate and work it and thus heat it and then is circulated through a heat exchanger.

All of the above three devices suffer from the problem that in a space heating unit it is impossible as a practical matter to balance the heat output of such a device with the heating requirement or demand such that the space heating units operate cyclically in the manner of an oil burning home furnace. The space heating device thus comes on when the temperature of the air being heated reaches a predetermined low level and turns off when the temperature of the output air reaches a predetermined high temperature and/or a room thermostat operates to turn it off. A problem with such cyclic operation is that there is a lag in the output of the heating device from the time it starts operating until the time it starts to supply air heated to the minimum desired temperature, i.e. the fluid shearing device must operate for some time before the fluid is raised to an operating temperature high enough for meaningful heat exchange to occur with the mass of circulating air to be heated.

Another problem caused by the necessary cyclic operation of a space heating unit of this type is that if one uses a viscous oil as the heating media, as preferred in the present invention, then as the unit cools when it is in its rest mode the oil becomes quite viscous and the power requirement and pressure generated at initial start-up can be excessive.

In brief compass this invention is a space heating unit comprising a motor driven pump which forces a working fluid, preferably a viscous oil, through a hydraulic circuit including a heat exchanger. The circuit receives the working fluid from the pump outlet and returns it to the pump inlet after the oil has passed through some form of flow restriction which causes a substantial pressure drop in and a working and shearing of the fluid thereby heating it in addition to the heating achieved by the pump and resistance to flow in the circuit. After it is thus heated, the circuit conducts the fluid through a heat exchanger, through which fluid to be heated is passed, and then returns it to the inlet of the pump.

There is preferably a working fluid by-pass connection in the heat exchange conduit which if desired can be used to pass working fluid from the conduit prior to the flow restriction to the return side of the conduit after the heat exchange means. This is particularly useful during the initial start-up of circulation, i.e. some of the working fluid can be by-passed to ease the start-up load on the pump and after the viscous fluid has been heated somewhat, the by-pass can be closed or partially closed. The by-pass can also be used as a means to in part control the temperature of the circulating working fluid in response to the demand on the heat exchange unit.

The particular improvement of this invention resides in providing a heat store contiguous to at least a portion of the heat exchange conduit preferably in the heat exchanger area, which heat store operates to extract and store heat from the circulating working fluid when it is at operating temperature and to return this energy to the working fluid when the space heating unit is in its rest mode whereby the working fluid can be maintained somewhat near its operating temperture ready for the next start-up and operating cycle. As will be appreciated, when the working fluid is a viscous oil the use of a heat store in this manner permits the start-up of a cycle to occur with the oil being relatively warm and thus of a substantially lower viscosity than would be the case if the heat store were not used.

Suitable heat store materials are hydrated salts which exhibit a reversible phase change from solid to liquid at a temperature practical for the purposes of space heating, e.g., a temperature in the range of 100° C. to 300° C.

The nature of this invention and its advantages will become clear from the following description made with reference to the attached drawing which is a diagrammatic sectional elevation of a friction space heater utilizing the invention.

In the drawing 10 refers to a cabinet which contains the basic operating components of the space heating unit. Cabinet 10 can be insulated as desired. Electric motor 11 in the lower portion of the cabinet drives by a belt 12 a positive displacement gear pump 13. The output of the pump is passed by conduit 14 to a heat exchanger coil 15 which in this case is an upwardly opening spiral helix. The oil under pressure is passed through a flow restriction means 16, e.g., an adjustable valve although other means can be used such as a single orifice or a series of orifices to produce a greater shearing and turbulance. The oil after having circulated through the heat exchange coil is transferred by lines 17 and 18 to the inlet side of the pump. Means 16 in operation is adjusted or sized to ensure turbulent flow of fluid in the hydraulic circuit.

Lines 19 and valve 20 may be used to bleed off any gases that might accumulate in the system, e.g., by reason of breakdown of the oil. Oil can be added to the system by surge tank 21, line 22 and valve 23 to maintain a predetermined amount thereof at a predetermined pressure in the circuit. The oil can be drained by line 24 and valve 25.

Oil can be by-passed from the flow restriction means 16 and heat exchanger coil 15 by line 26 and control valve 27. This by-pass can be automatically controlled if desired to allow some by-pass of the oil from the pump outlet to the pump inlet during the beginning portion of the heating cycle and/or to regulate the amount of work done on the oil and thus the amount of heat energy available in coil 15. For example, valve 27 can be a pressure relief valve that opens when the pressure in line 14 becomes excessive, and automatically closes when normal operating pressures are established.

Air is supplied to the coil 15 by blower 30 which has inlet 31. Air that has been heated by passage through the coil is removed by line 32 and passed directly into the room or through such ducting as may be desired.

Cabinet 10 is shown in section except for a portion 40 which shows the front of a cabinet which may have a control panel 41 thereon to permit control of the space heating unit and to display its operating conditions.

As previously stated a main feature of this invention is the provision of a heat store generally indicated at 50 about the heat exchange coil 15. A cylindrical wall 51 separates the heat store material from coil 15 and forms a chamber with the walls of the cabinet or another cylindrical wall to hold the material when it is in its liquid form. The heat store takes up heat energy from the oil circulating in coil 15 when the unit is operating above a predetermined temperature, say 150° F., and preferably stores it by reason of a phase change as for example by turning from a solid into a liquid. Heat store 50 when the unit cools appreciably below the predetermined temperature then returns heat energy to the system by reversibly crystallizing to a solid stage giving up heat in the process. Any one of several eutectic salt mixtures can be used for this purpose. These are salt mixtures of sodium and potassium chlorides, nitrates, nitrites, and sulfates. See Energy Technology Handbook, Douglas M. Considine, Editor, McGraw Hill Book Company, New York, New York 1977, Library of Congress Catalog Number ISBM 0-07-012430-2, Page 6–43 and the references cited at Page 6–44. Specifically one may use the salt mixture "HITEC" of the Coastal Chemical Company, Evan Street Extension, Greenville, North Carolina 27834, which comprises potassium nitrate 53%, sodium nitrite 40% and sodium nitrate 7%. It has a freezing point when fresh of 142° C.

When the space heating unit is in its at-rest mode, heat store 50 gradually releases the stored heat energy over a period of several hours if need be thus maintaining the temperature of the working fluid near the solid/-liquid phase change temperature of the eutectic salt mixture. This has two principal advantages. First, when a heavy hydrocarbon oil is used, which is preferred, which is quite viscous at room temperature the maintaining of it at an elevated temperature greatly reduces the viscosity and consequently greatly reduces the amount of energy that must be delivered by motor 11 to start-up the unit at a beginning of a cycle. Secondly, when a thermostat or the like has caused the unit to come on, one normally wishes reasonably warm air to be promptly delivered by the unit from pipe 32. As the coil 15 has been maintained at an elevated temperature by heat store 50 blower 30 can immediately commence to deliver ambient air to the unit and the unit will put out warm air at 32 prior to the time that the circulating working fluid has been brought up to full operating temperature.

Coil 15 may be designed in many different configurations to maximize the exposure of surface to air passing therethrough and to increase the turbulence of the air to increase the effective heat transfer. Coil 15 may have heat exchange fins and heat exchange fins or deflectors may be placed in its interior passageway. Different serpentine constructions can be used for the coil as may be desired. In addition planar heat exchange designs of flat plate or unitary tube construction may be utilized.

Blower 30 can, if desired, be thermostatically controlled not to come on until the working fluid reaches a predetermined minimum temperature, say 60% of its normal operating temperature and to continue to operate until the working fluid temperature drops below that predetermined temperature.

While the working fluid could be water under pressure, it is preferred to use an oil mixture of 85% synthetic automatic transmission fluid with 15% heavy gear oil at approximately atmospheric pressure as a working fluid. More particularly a synthetic oil such as AMS/OIL Dexron II with AMS/OIL 85W-140 gear lube (AMS/OIL INC., AMS/OIL Building, Superior, Wisconsin 54880) can be used.

I claim:

1. A space heater comprising:

(a) a motor driven pump adapted to the forcing of a working fluid through a hydraulic circuit;

(b) a hydraulic circuit filled with said working fluid and receiving said working fluid from the outlet of said pump and returning said working fluid to the inlet thereof;

(c) flow restricting means in said hydraulic circuit effecting a substantial pressure drop in and shearing of said working fluid circulating therethrough to produce turbulent flow of said fluid;

(d) fluid circulating means for circulating fluid to be warmed by heat exchange contact with at least a portion of said hydraulic circuit; and (e) a phase change heat store means comprising in at least one of its operable phases thereof a solid in heat exchange relationship with a portion of said hydraulic circuit and said working fluid therein, said phase change heat store means by reason of a phase change thereof removing heat energy from said hydraulic circuit when the temperature of said working fluid therein exceeds a predetermined level and returning said heat energy thereto when said temperature falls below said predetermined level;

wherein said hydraulic circuit includes an elongated coil, said circulating fluid is circulated over the surface of the coil and said solid of said phase change heat store means is disposed around the exterior thereof and there is a by-pass conduit connecting with said hydraulic circuit after the outlet of said pump and upstream of said flow restricting means and after said cylindrical coil.

2. The space heater of claim 1 including fluid control means associated with said hydraulic circuit adapted to maintain a predetermined amount of fluid at a predetermined pressure therein.

3. The space heater of claim 1 wherein said pump is a positive displacement gear pump and said working fluid comprises a hydrocarbon oil highly viscous at room temperature.

4. The space heater of claim 1 wherein said flow restricting means is an adjustable valve creating turbulance in the fluid passing therethrough.

* * * * *